US009391379B1

(12) United States Patent
Huang

(10) Patent No.: US 9,391,379 B1
(45) Date of Patent: Jul. 12, 2016

(54) COAXIAL CONNECTOR DEVICE

(71) Applicant: Din Yi Industrial Co., Ltd., New Taipei (TW)

(72) Inventor: Ching Kun Huang, New Taipei (TW)

(73) Assignee: DIN YI INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 14/797,988

(22) Filed: Jul. 13, 2015

(51) Int. Cl.
*H01R 9/05* (2006.01)

(52) U.S. Cl.
CPC ..... *H01R 9/0506* (2013.01)

(58) Field of Classification Search
CPC ..... H01R 17/12
USPC ..... 439/578, 582–585
See application file for complete search history.

(56) References Cited

U.S. PATENT DOCUMENTS

2007/0102042 A1* 5/2007 Thrash ..... F16K 3/265 137/112
2013/0288516 A1* 10/2013 Chang ..... H01R 13/465 439/488
2015/0132992 A1* 5/2015 Holland ..... H01R 24/44 439/578

* cited by examiner

*Primary Examiner* — Phuongchi T Nguyen
(74) *Attorney, Agent, or Firm* — Rabin & Berdo, P.C.

(57) ABSTRACT

A coaxial connector device includes a connector bank with closely arranged installation connectors; a male connector including a screw-on section defining a first circumferential surface of a first outer diameter, a cable receiving section defining a second circumferential surface of a second outer diameter, and a tightening section axially located between the screw-on and the cable receiving section; a cable having an end extended through the male connector to electrically connect to one of the installation connectors; and a female connector connected to another end of the cable. The tightening section defines multiple grip sides, which are respectively located tangentially relative to the second circumferential surface with two lateral edges flush with the first circumferential surface, giving the tightening section a reduced size. Therefore, multiple male connectors can be conveniently screwed onto the closely arranged installation connectors while the fully assembled coaxial connector device can have an effectively reduced volume.

11 Claims, 10 Drawing Sheets

COAXIAL CONNECTOR DEVICE

FIELD OF THE INVENTION

The present invention relates to a coaxial connector device, and more particularly to a coaxial connector device that allows an increased number of cables to be arranged in a predetermined limited space.

BACKGROUND OF THE INVENTION

Coaxial cables are used with cable television sets and the Internet to transmit and receive electrical signals. In practical application, the coaxial cable is first assembled to a coaxial connector, which is then connected to an electronic product, allowing the electronic product to receive or transmit signals via the coaxial cable.

FIG. 1 shows a currently widely available conventional cable connector device 1, which includes a male connector 10, a female connector 11, a connector bank 12 and a cable 13. On a predetermined position of the male connector 10, there is formed a radially outward expanded multi-sided tightening section 101. That is, the multi-sided tightening section 101 has an outer peripheral surface diametrically larger than other portions of the male connector 10. The connector bank 12 includes a plurality of installation connectors 121 spaced from one another. The cable 13 has an end extended through the male connector 10 to be fixedly held in one installation connector 121 and another end extended into the female connector 11 and be held therein.

To connect the cable 13 to the installation connector 121 via the male connector 10, an operator first fit a fastening tool (not shown in FIG. 1) around the multi-sided tightening section 101 of the male connector 10, so as to screw the male connector 10 onto the installation connector 121. Then, the operator extends one end of the cable 13 through the male connector 10 into the installation connector 121, and mounts the female connector 12 onto the other end of the cable 13.

With the radially expanded multi-sided tightening section 101 formed on the male connector 10, the installation connectors 121 on the connector bank 12 must be spaced from one another by a distance large enough for the fastening tool set around the tightening section 101 to locate between adjacent installation connectors 121 and screw the male connector 10 onto the installation connector 121. In the event the distance between the adjacent installation connectors 121 is too small to receive the fastening tool therein, the fastening tool for screwing another male connector 10 will inevitable touch and be interfered by the tightening section 101 on an adjacent male connector 10 that has previously been connected to the installation connector 121, preventing the fastening tool from screwing the other male connector 10 to its corresponding installation connector 121.

To ensure that every male connector 10 can be successfully screwed onto a corresponding installation connector 121, the large distance must be formed between any two adjacent installation connectors. As a result, the cables 13 having been connected at two ends to the male and the female connector 10, 11 would occupy a relatively large area. That is, the conventional cable connector device 1 in a fully assembled state is very large in volume and not convenient for use.

To overcome the disadvantages of the conventional cable connector device, it is tried by the inventor to develop an improved coaxial connector device that includes a male connector with a diametrically reduced tightening section, so that more cables can be conveniently connected to a connector bank having closely arranged installation connectors while the fully assembled coaxial connector device can have an effectively reduced volume.

SUMMARY OF THE INVENTION

A primary object of the present invention is to provide a coaxial connector device, which allows a plurality of male connectors to be conveniently screwed onto a plurality of closely arranged installation connectors, so that cables connected to the male connectors can also be closely arranged side by side to effectively save the space for cable connection.

Another object of the present invention is to provide a coaxial connector device that includes specially designed male and female connectors, allowing a cable to be quickly connected at two ends to the male and female connectors to thereby largely shorten the time needed to assemble the cable to the male and female connectors.

To achieve the above and other objects, the coaxial connector device provided according to the present invention includes a male connector, a female connector, a cable and a connector bank.

The male connector is formed of an inner tube, a first shell and a second shell. The inner tube internally defines a straight-through space and has a first abutting block externally formed around an end thereof. The first shell externally defines a first circumferential surface of a first outer diameter, and internally defines a screw-on space axially extended through the first shell and a second abutting block radially inward extended into the screw-on space. The first shell is externally fitted around an end of the inner tube to provide a screw-on section of the male connector while the second abutting block is abutted against and hooked to the first abutting block, so that the inner tube has a portion projected from the first shell and the screw-on space of the first shell is communicable with the straight-through space of the inner tube.

The second shell of the male connector externally defines a second circumferential surface of a second outer diameter and is externally fitted around the portion of the inner tube that is projected from the first shell, so that the second shell and the inner tube together form a cable receiving section of the male connector and an annular receiving space is defined between the second shell and the inner tube. The annular receiving space is externally located around the straight-through space and does not communicate with the screw-on space.

The male connector is characterized in further having a tightening section axially located between the screw-on section and the cable receiving section. The tightening section externally defines at least one grip side, which is located tangentially relative to the second circumferential surface of the second shell and has two lateral edges located flush with the first circumferential surface of the first shell.

The female connector includes a first tubular body, a second tubular body and a first electrical connection member. The second tubular body internally defines an insertion space and has an extended sleeve portion. The first tubular body is externally fitted around the extended sleeve portion of the second tubular body, so that an annular locating space is defined between the extended sleeve portion and the first tubular body. The annular locating space does not communicate with the insertion space defined in the second tubular body. The first tubular body and the extended sleeve portion of the second tubular body together form a cable insertion section of the female connector, and a length of the second tubular body other then the extended sleeve portion forms an electrical connection section of the female connector.

The first electrical connection member is located in the electrical connection section of the female connector. In a preferred embodiment of the present invention, the first electrical connection member has a conducting sleeve, a first claw element located in each of two opposite ends of the conducting sleeve, and an annular cover fixedly held in the electrical connection section of the female connector to cover and hold the two first claw elements and the conducting sleeve in place. Each of the first claw elements includes a plurality of circumferentially spaced first claws. Ends of the first claws that are axially pointed outward in the conducting sleeve are substantially parallel to one another to form a ring-shaped structure, and another ends of the first claws that are axially pointed inward in the conducting sleeve are converged to form a tapered structure.

The cable has a central core and an insulation layer covering most part of the central core with only two opposite ends of the central core being exposed from two ends of the insulation layer to form a first and a second end of the cable. The cable further has a braided conductor and a jacket sequentially covering the insulation layer. The first end of the cable is extended through the cable receiving section into the screw-on section of the male connector to be clamped and held in place in the core clamping section of the installation connector, enabling the first end of the cable to be electrically connected to the contacting section of the installation connector. When the cable is extended from the first end through the straight-through space into the screw-on space, the central core at the first end and the insulation layer behind the first end are located in the screw-on space and the straight-through space, respectively, while the braided conductor and the jacket are located in the annular receiving space, and the annular receiving space and the straight-through space are communicable with each other via an annular recess formed on the insulation layer adjacent to the first end.

The second end of the cable is extended through the cable insertion section into the electrical connection section of the female connector and is held therein. When the cable is extended from the second end into the insertion space of the female connector, the central core at the second end and the insulation layer behind the second end all are located in the insertion space while the braided conductor and the jacket all are located in the annular locating space, and the annular locating space and the insertion space are communicable with each other via another annular recess formed on the insulation layer adjacent to the second end.

The connector bank includes a base and a plurality of installation connectors mounted on the base to space from one another by a predetermined distance, and each of the installation connectors has a core clamping section and a contacting section formed at two opposite ends thereof. Each of the installation connectors further has a second electrical connection member mounted in the core clamping section; and the second electrical connection member is connected at an end to the contacting section and at another end to the first end of the cable.

The screw-on section of the male connector is screwed onto the core clamping section of the installation connector with the help of the tightening section on the male connector, so that the first end of the cable is located in the core clamping section and electrically connected to the contact section of the installation connector.

In a preferred embodiment of the present invention, the second electrical connection member includes a main body, a passage axially extended through the main body, and a second claw element provided in the passage and including a plurality of second claws. Ends of the second claws facing toward the contacting section respectively form a first clamping portion and another ends of the second claws facing away from the contacting section respectively form a second clamping portion. The second clamping portion is further divided into a core clamping segment for clamping and holding the first end of the cable in place in the passage and a core guiding segment for guiding the first end of the cable into the passage.

The installation connector further includes an axially extended conducting element located in the contacting section, and the conducting element has an end clamped by the first clamping portions of the second electrical connection member. The core guiding segments of the second claws are separated from one another to present a flared state, while the core clamping segments of the second claws are converged to press against one another.

As can be found from the above description, the coaxial connector device of the present invention is characterized in that, on the male connector, the grip sides of the tightening section are located tangentially relative to the second circumferential surface and respectively have two axially extended lateral edges located flush with the first circumferential surface, so that the tightening section has an outer peripheral surface radially located between the first circumferential surface and the second circumferential surface. With this configuration, multiple male connectors can be conveniently connected one by one to the core clamping sections of the closely spaced installation connectors on the connector bank. And, the coaxial connector device with multiple cables, male connectors and female connectors connected to all the installation connectors on the connector bank can have an effectively reduced overall volume.

Further, with the annular receiving space of the male connector and the annular locating space of the female connector, when the cable is inserted at the first and second ends into the male and female connectors, respectively, portions of the braided conductor and the jacket of the cable located adjacent to the first end and the second are automatically moved into the annular receiving space and the annular locating space, respectively. In this manner, the portion of the central core at the first end of the cable can be quickly extended through the male connector to electrically connect to the second electrical connection member of the installation connector, and another portion of the central core at the second end of the cable can also be quickly extended into the female connector to electrically connect to the first electrical connection member.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
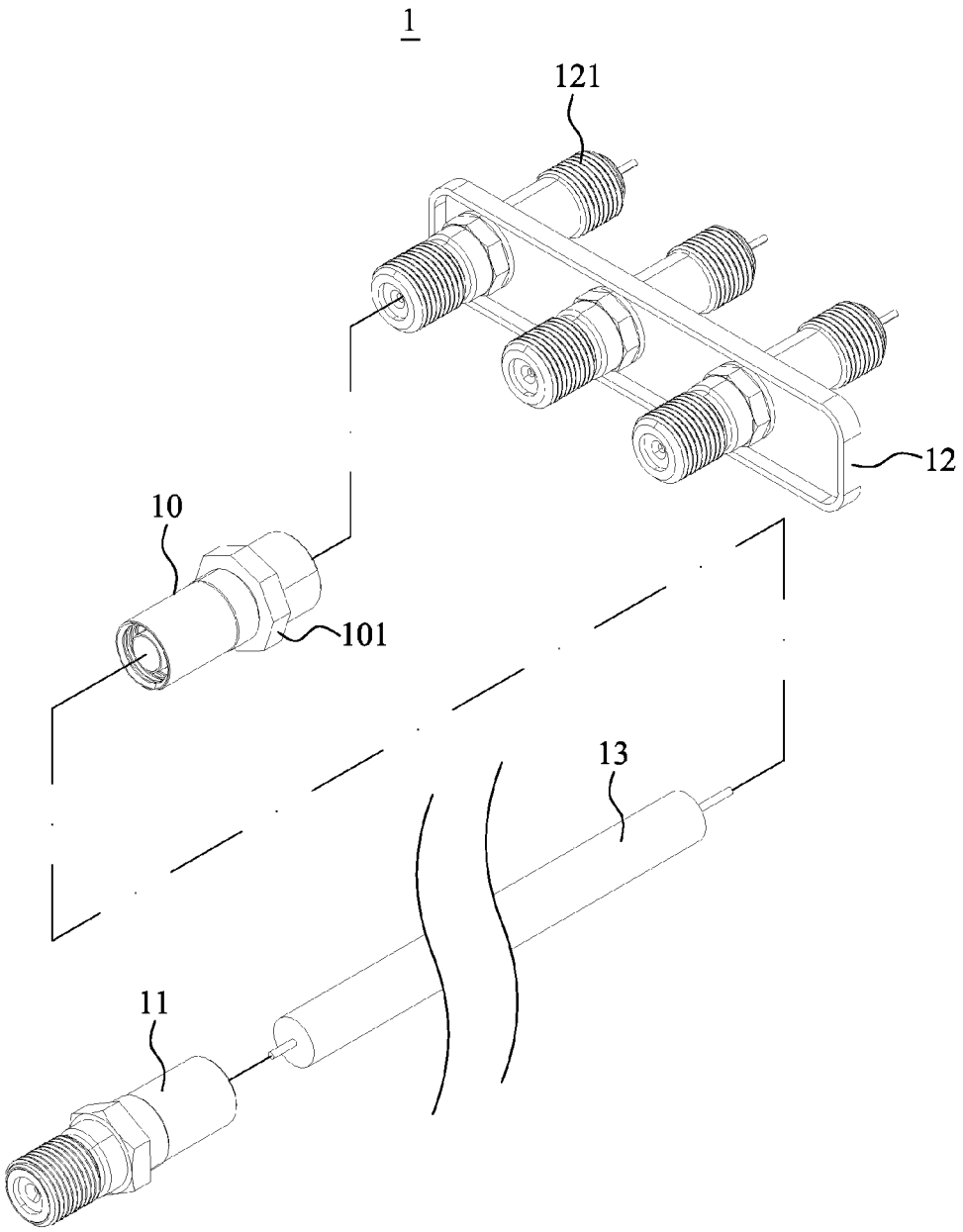
FIG. 1 (Prior Art)
FIG. 1 is an exploded perspective view of a conventional cable connector device.
Figure 2:
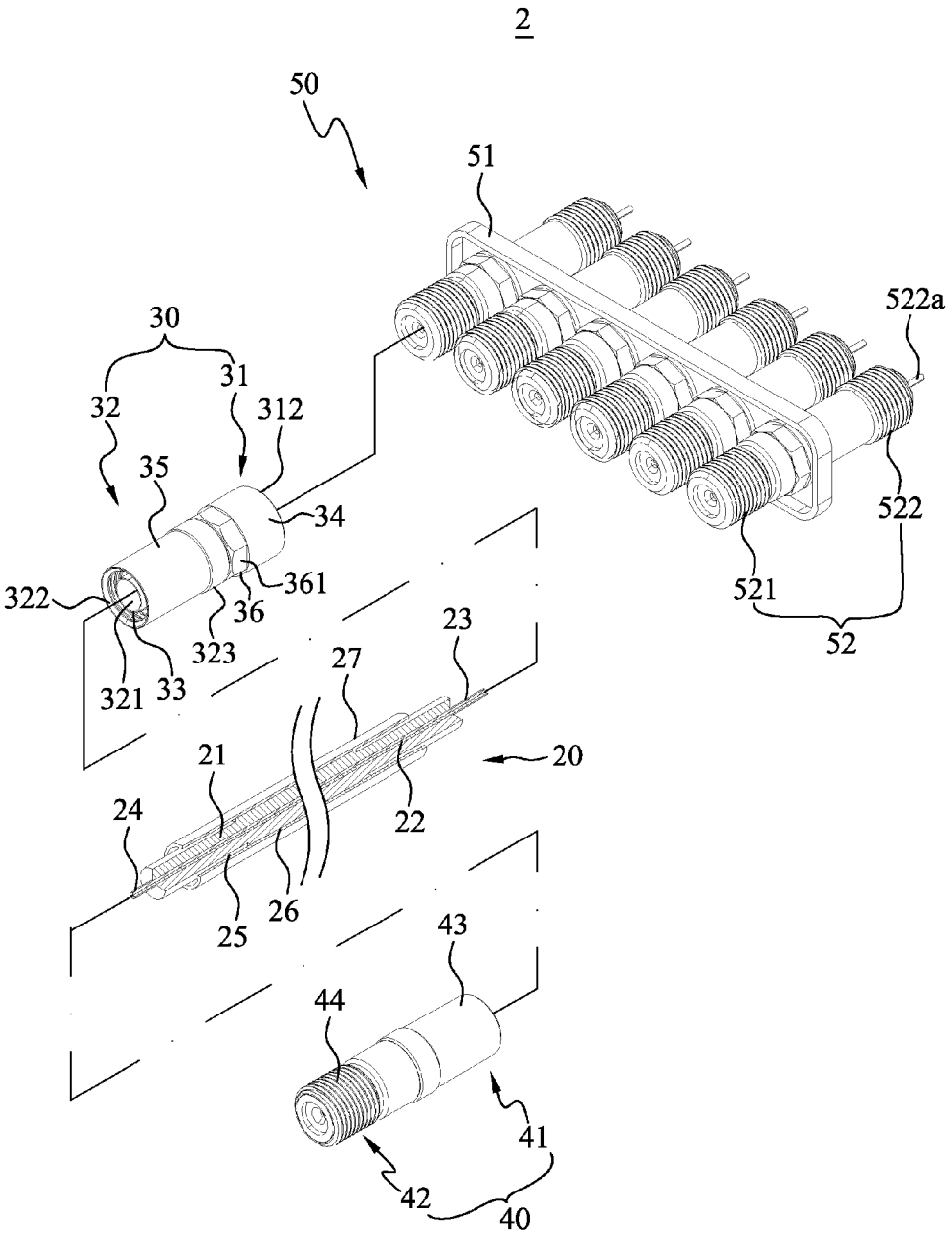
FIG. 2 is an exploded perspective view of a coaxial connector device according to a preferred embodiment of the present invention.

Please refer to FIG. 2, which is an exploded perspective view of a coaxial connector device 2 according to a preferred embodiment of the present invention. As shown, the coaxial connector device 2 includes a cable 20, a male connector 30, a female connector 40, and a connector bank 50.

The cable 20 has an insulation layer 21 and a central core 22. The insulation layer 21 covers most part of the central core 22, such that only two opposite ends of the central core 22 are exposed from two ends of the insulation layer 21 to form a first end 23 and a second end 24 of the cable 20. The insulation layer 21 is formed on an inner circumferential surface at each of two ends thereof with an annular recess 25, so that two lengths of the central core 22 corresponding to the two annular recesses 25 are spaced from the insulation layer 21. Further, the cable 20 also has a braided conductor 26 and a jacket 27 that sequentially cover the insulation layer 21.

Figure 3:
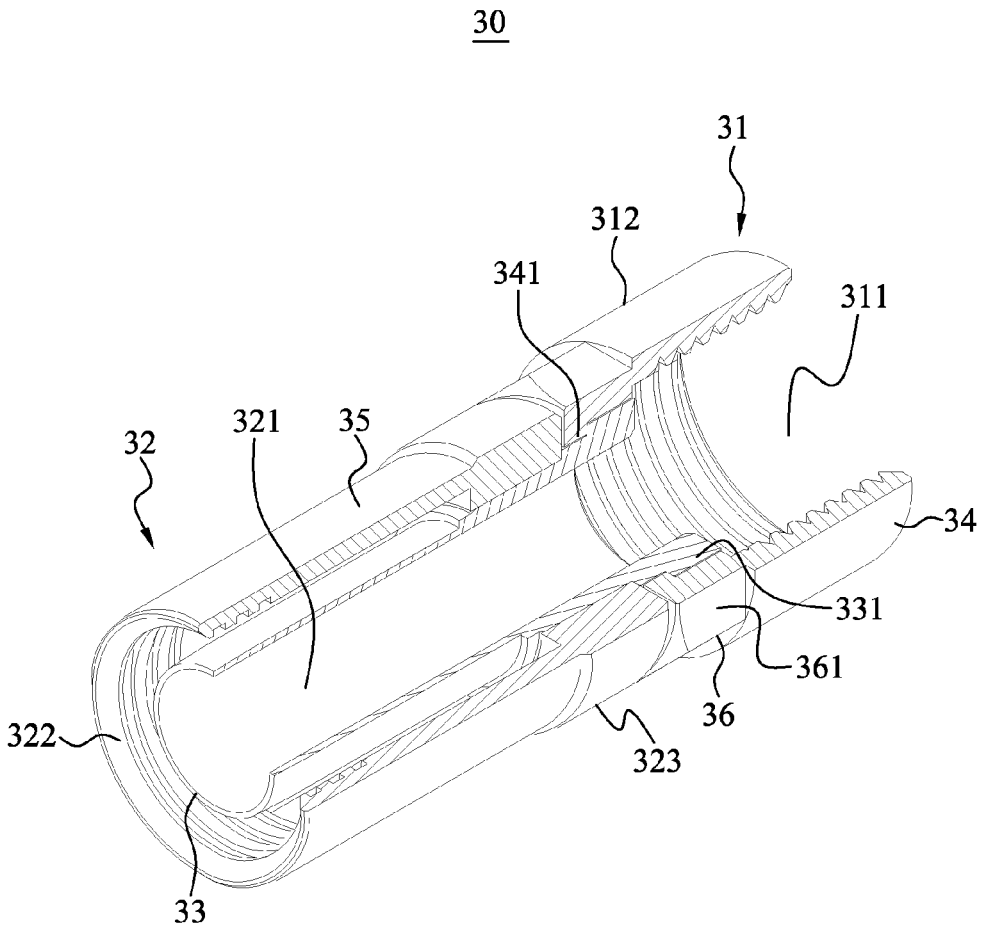
FIG. 3 is a cutaway view of a male connector included in the coaxial connector device of the present invention.

Please refer to FIG. 3. The male connector 30 is divided into a screw-on section 31 and a cable receiving section 32. More specifically, the male connector 30 is formed of an inner tube 33, a first shell 34 and a second shell 35. The first shell 34 internally defines a screw-on space 311, which is located corresponding to the screw-on section 31. The inner tube 33 internally defines a straight-through space 321, which is located corresponding to the cable receiving section 32 and communicable with the screw-on space 311. And, the second shell 35 is externally located around the inner tube 33, so that an annular receiving space 322 is formed between the second shell 35 and the inner tube 33 to locate around the straight-through space 321 and corresponding to the cable receiving section 32. The straight-through space 321 is located in the inner tube 33 and does not communicate with the annular receiving space 322.

The inner tube 33 has a radially outward extended first abutting block 331 externally formed around an end thereof. Meanwhile, The first shell 34 has a second abutting block 341 internally formed around an end thereof to radially inward extend into the screw-on space 311 for externally fitting around the inner tube 33, such that the second abutting block 341 is abutted against and hooked to the first abutting block 331. In this connected position, the inner tube 33 has a portion projected into the first shell 34 and another portion projected from the first shell 34. The second shell 35 is externally fitted around the portion of the inner tube 33 that is projected from the first shell 34 to define the annular receiving space 322 between the second shell 35 and the inner tube 33.

As can be seen in FIG. 3, The screw-on section 31 of the male connector 30 has a first circumferential surface 312 corresponding to the first shell 34 and having a first outer diameter. Meanwhile, the cable receiving section 32 of the male connector 30 has a second circumferential surface 323 corresponding to the second shell 35 and having a second outer diameter. It is noted the male connector 30 further has a tightening section 36 formed on the first shell 34 to axially locate between the screw-on section 31 and the cable receiving section 32. The tightening section 36 externally defines a plurality of grip sides 361, which are radially located between the first circumferential surface 312 and the second circumferential surface 323. The male connector 30 is characterized in that the grip sides 361 are located tangentially relative to the second circumferential surface 323 and respectively have two axially extended lateral edges located flush with the first circumferential surface 312. Thus, the tightening section 36 has an outer peripheral surface radially located between the first circumferential surface 312 and the second circumferential surface 323.

Figure 4:
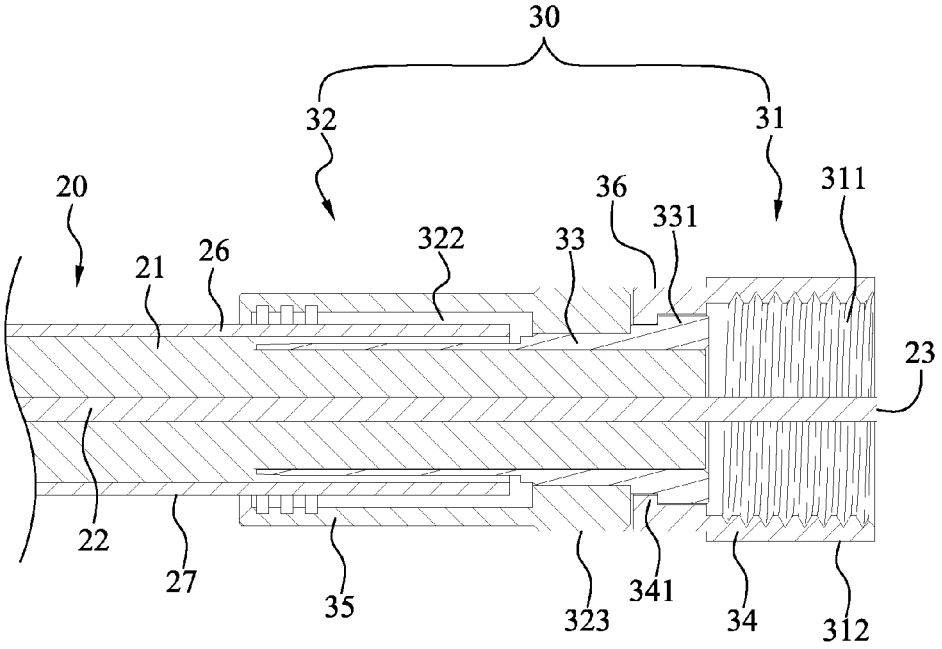
FIG. 4 is a sectional view showing the male connector of FIG. 3 with a first end of a cable connected thereto.

Please refer to FIG. 4. To connect the cable 20 to the male connector 30, first extend the first end 23 of the cable 20 through the straight-through space 321 into the screw-on space 311 of the male connector 30. At this point, the braided conductor 26 and the jacket 27 located behind and adjacent to the first end 23 are automatically moved into the annular receiving space 322, indirectly allowing the insulation layer 21 to quickly locate in the straight-through space 321. The central core 22 at the first end 23 of the cable 20 is now located in the screw-on space 311 to be flash with or extended beyond the screw-on section 31 of the male connector 30. At this point, the annular receiving space 322 and the straight-through space 321 are communicable with each other via the annular recess 25 formed on the insulation layer 21 adjacent to the first end 23 of the cable 20.

Figure 5:
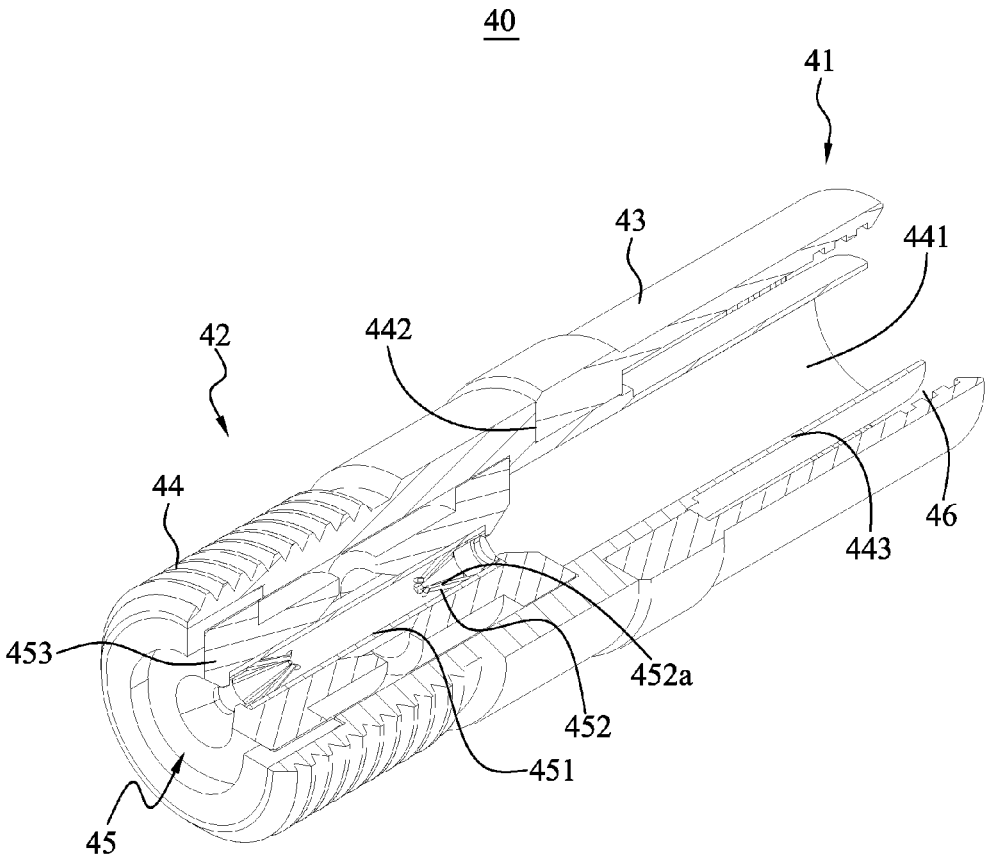
FIG. 5 is a cutaway view of a female connector included in the coaxial connector device of the present invention.

Please refer to FIG. 5. The female connector 40 is divided into a cable insertion section 41 and an electrical connection section 42. More specifically, the female connector 40 is formed of a first tubular body 43, a second tubular body 44, and a first electrical connection member 45 located in the second tubular body 44 corresponding to the electrical connection section 42. The second tubular body 44 internally defines an insertion space 441, which is extended through the cable insertion section 41 and the electrical connection section 42. The second tubular body 44 is externally formed at a position with an annular shoulder portion, on which an annular pressing face 442 is defined. A portion of the second tubular body 44 horizontally extended from the pressing face 442 forms a diametrically reduced extended sleeve portion 443. The first tubular body 43 is externally located around the extended sleeve portion 443 of the second tubular body 44 with an end of the first tubular body 43 pressed against the pressing face 442 of the second tubular body 44. As can be seen in FIG. 5, an annular locating space 46 is defined between the extended sleeve portion 443 and the first tubular body 43, and is located corresponding to the cable insertion section 41. The annular locating space 46 does not communicate with the insertion space 441.

The first electrical connection member 45 has an end connected to the second end 24 of the cable 20, and another end connectable to the first end 23 of an additional cable 20, such that the second end 24 of the cable 20 and the first end 23 of the additional cable 20 are electrically connectable to each other via the first electrical connection member 45. As can be seen in FIG. 5, the first electrical connection member 45 has a conducting sleeve 451 and a first claw element 452 located in each of two opposite ends of the conducting sleeve 451. An annular cover 453 is fixedly held in the electrical connection section 42 of the female connector 40 for covering and holding the two first claw elements 452 and the conducting sleeve 451 in place. Each of the first claw elements 452 includes a plurality of circumferentially spaced first claws 452*a*. Ends of the first claws 452*a* that are axially pointed outward in the conducting sleeve 451 are substantially parallel to one another to form a ring-shaped structure, and another ends of the first claws 452*a* that are axially pointed inward in the conducting sleeve 451 are converged to form a tapered structure. The converged ends of the two pieces of first claws 452*a* function to clamp the second end 24 of the cable 20 and the first end 23 of the additional cable 20 in place in the first electrical connection member 45, such that the cable 20 and the additional cable 20 are electrically connectable to each other via the conducting sleeve 451.

Figure 6:
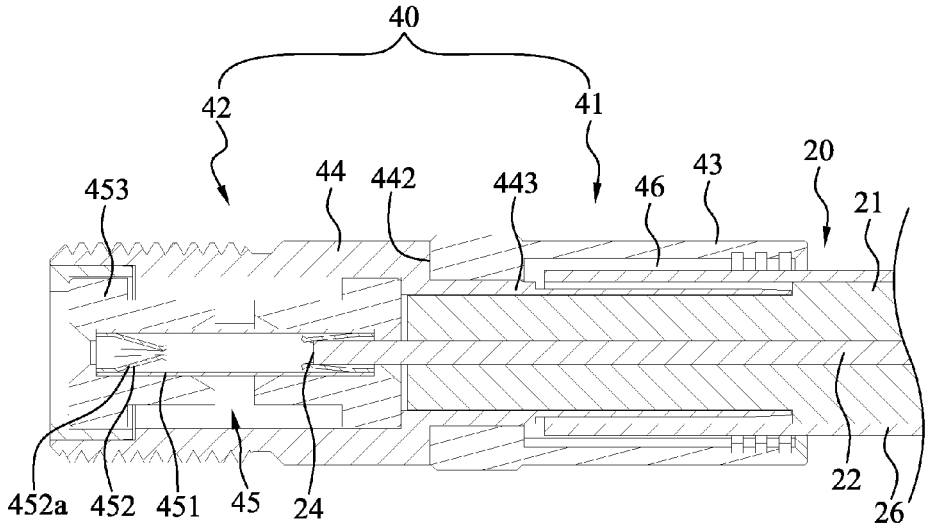
FIG. 6 a sectional view showing the female connector of FIG. 5 with a second end of the cable connected thereto.

Please refer to FIG. 6. When the cable 20 is inserted from its second end 24 into the insertion space 441 of the female connector 40, the braided conductor 26 and the jacket 27 of the cable 20 located behind and adjacent to the second end 24 are automatically moved into the annular locating space 46, indirectly allowing the central core 22 and the insulation layer 21 at the second end 24 of the cable 20 to be quickly held in the insertion space 441. As can be seen in FIG. 6, when the central core 22 at the second end 24 of the cable 20 is moved into the conducting sleeve 451 of the first electrical connection member 45, it is clamped and held in place by the first claws 452*a* of one of the first claw elements 452 located closer to the first tubular body 43. At this point, the annular locating space 46 and the insertion space 441 are communicable with each other via the annular recess 25 formed on the insulation layer 21 adjacent to the second end 24 of the cable 20.

As can be seen in FIG. 2, the connector bank 50 includes a base 51 and a plurality of installation connectors 52 mounted on the base 51. Please refer to FIG. 7. Each of the installation connectors 52 has a core clamping section 521 forming an end thereof and a contacting section 522 forming another end thereof. The contacting section 522 is located behind the base 51 for mounting to a chassis (not shown). Inside the core clamping section 521, there is mounted a second electrical connection member 53. And, inside the contacting section 522, there is an axially extended conducting element 522*a* electrically connected at an end to the second electrical connection member 53.

Figure 7:
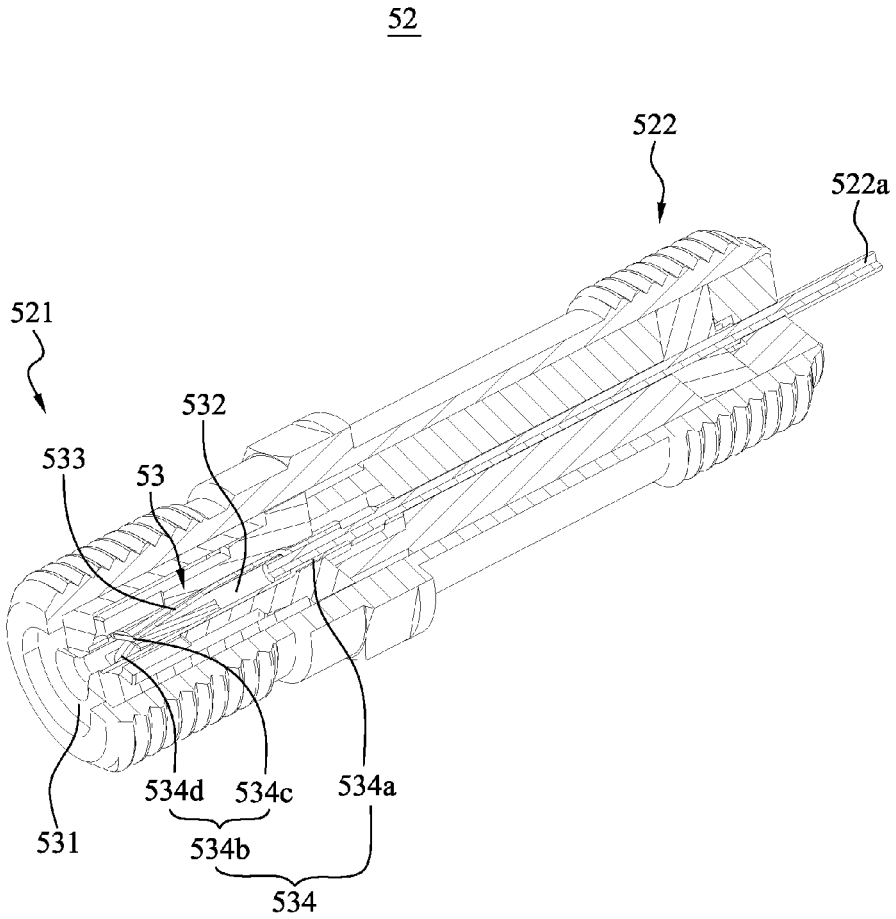
FIG. 7 is a cutaway view of an installation connector included in the coaxial connector device of the present invention.

As shown in FIG. 7, the second electrical connection member 53 has a main body 531 and a passage 532 axially extended through the main body 531. Inside the passage 532, there is provided a second claw element 533, which is formed of a plurality of second claws 534. Ends of the second claws 534 facing toward the contacting section 522 respectively form a first clamping portion 534*a* for clamping the conducting element 522*a* in place; and another ends of the second claws 534 facing away from the contacting section 522 respectively form a second clamping portion 534*b*. The second clamping portions 534*b* are respectively further divided into a core clamping segment 534*c* and a core guiding segment 534*d*. The core clamping segments 534*c* together clamp and hold the central core at the first end 23 of the cable 20 in place in the passage 532 and the core guiding segments 534*d* together guide the central core 22 at the first end 23 of the cable 20 into the passage 532.

The core guiding segments 534*d* of the second claws 534 are separated from one another to present a flared state, while the core clamping segments 534*c* of the second claws 534 are converged to press against one another.

Figure 8:
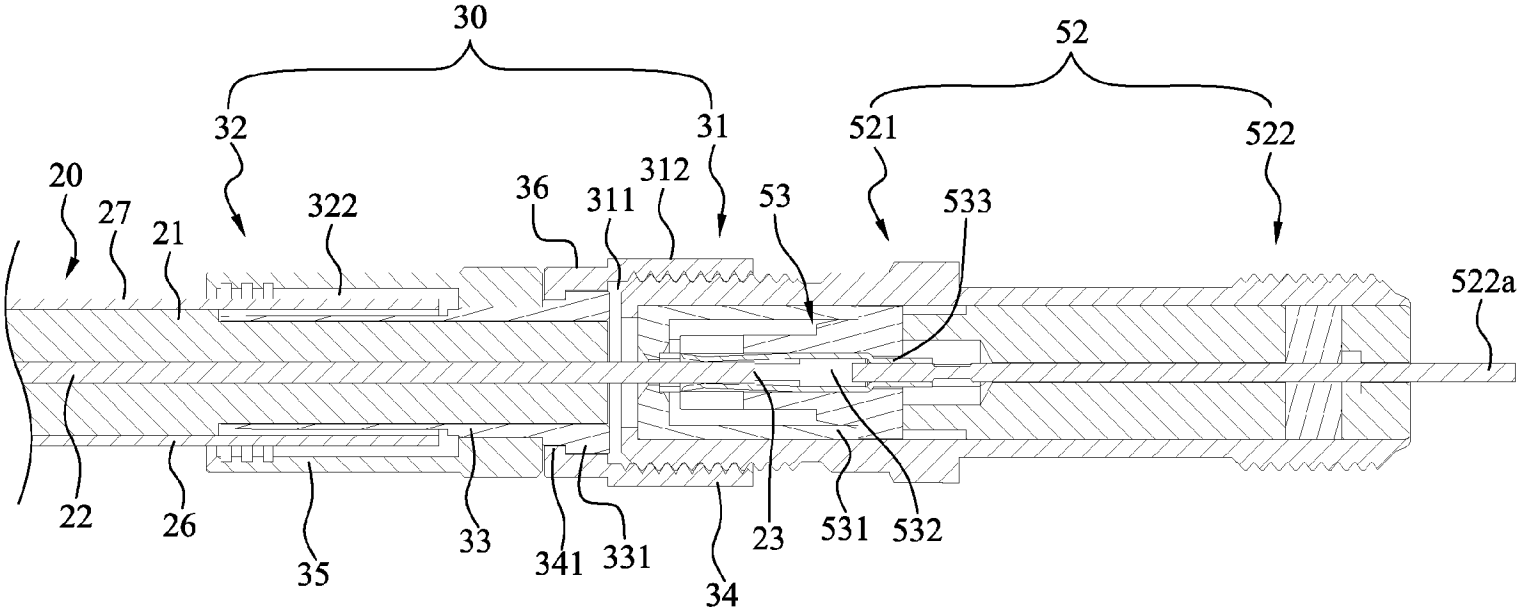
FIG. 8 is a sectional view showing the installation connector of FIG. 7 with the cable and the male connector connected thereto.

Referring to FIG. 8, the male connector 30 can be connected to the installation connector 52 by screwing the screw-on section 31 of the male connector 30 onto the core clamping section 521 of the installation connector 52, allowing the screw-on space 311 and the passage 532 to communicate with each other. Thus, the first end 23 of the cable 20 extended through the straight-through space 321 into the screw-on space 311 is guided into the passage 532 by the core guiding segments 534*d* of the second clamping portion 534*b* of the second claws 534 before it is clamped and held in place by the core clamping segments 534*c* of the second clamping portion 534*b*.

Figure 9:
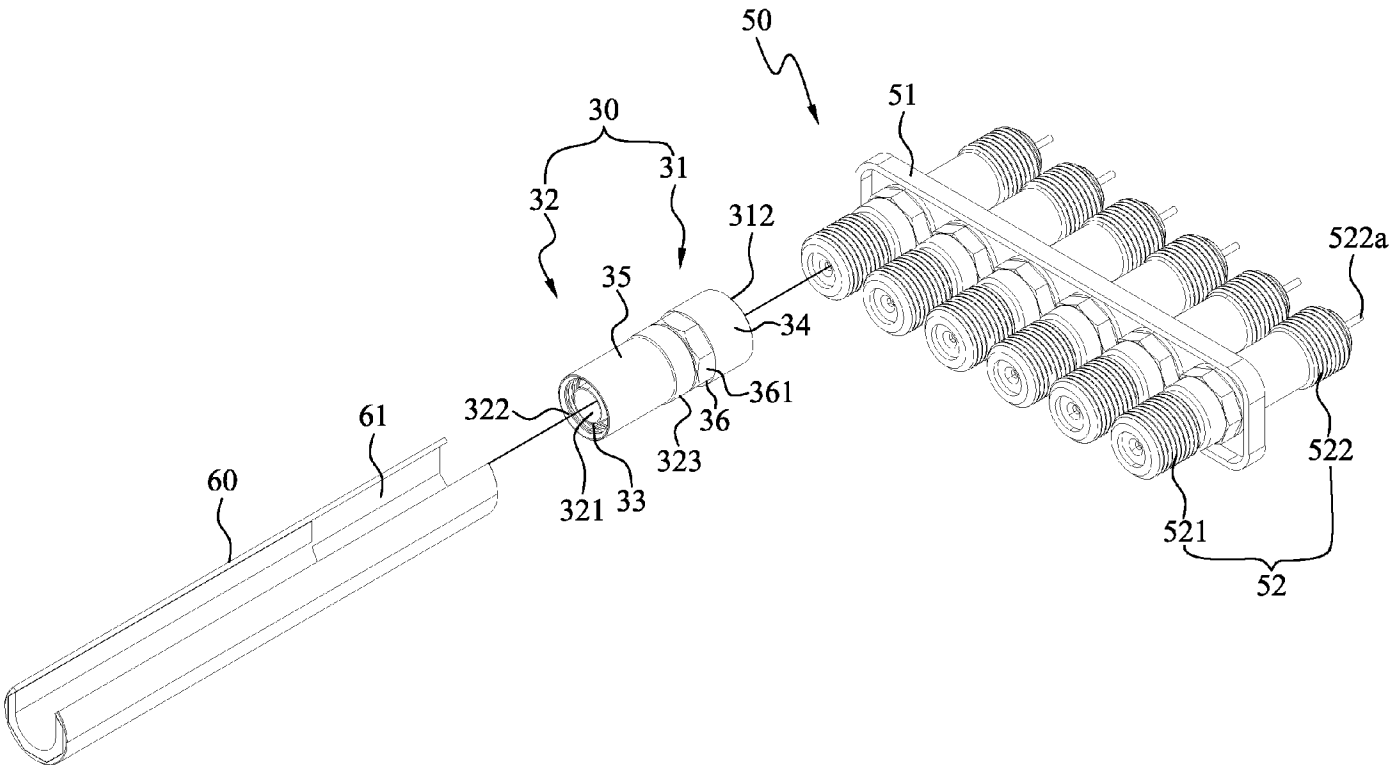
FIG. 9 is an exploded perspective view showing the use of a fastening tool to connect the male connector to the installation connector.

As shown in FIG. 9, the male connector 30 is screwed onto the installation connector 52 using a fastening tool 60. The fastening tool 60 internally defines an axially extended engaging space 61, which is configured and sized corresponding to the tightening section 36 of the male connector 30. A user may fit the fastening tool 60 around the male connector 30 with the grip faces 361 of the tightening section 36 fixedly engaged with the engaging space 61, and then rotates the fastening tool 60 to screw the screw-on section 31 of the male connector 30 onto the core clamping section 521 of the installation connector 52.

After the male connector 30 has been connected to the installation connector 52, the cable 20 is extended from its first end 23 into the male connector 30 and the core clamping section 521 of the installation connector 52. At this point, the first end 23 of the cable 20 is located in the passage 532 to be clamped and held in place by the core clamping segments 534*c* of the second clamping portion 534*b* of the second claws 534. When the central core 22 at the first end 23 of the cable 20 is clamped and held in place by the core clamping segments 534*c*, the central core 22 is electrically connected to the conducting element 522*a* of the installation connector 52 via the second electrical connection member 53. Then, a tightening element (not shown) is tightened against the cable receiving section 32 of the male connector 30 for the braided conductor 26 and the jacket 27 of the cable 20 to be tightly received in the annular receiving space 322 of the male connector 30. Finally, the cable 20 is extended from the second end 24 into the female connector 40 via the first tubular body 43 thereof, so that the second end 24 of the cable 20 is clamped and held in place by one of the first claw elements 452 that is located closer to the first tubular body 43.

As can be seen in FIG. 9, the grip sides 361 of the tightening section 36 are located tangentially relative to the second circumferential surface 323 and respectively have two axially extended lateral edges located flush with the first circumferential surface 312. Thus, the tightening section 36 has an outer peripheral surface radially located between the first circumferential surface 312 and the second circumferential surface 323. With the tightening section 36 being configured in the above described manner, the fastening tool 60 can also has a reduced size to have an engaging space 61 just large enough to fixedly engage with the grip faces 361.

Further, with the above-configured tightening section 36, multiple male connectors 30 can be easily screwed onto the installation connectors 52 one by one with the small-volume fastening tool 60, which allows the installation connectors 52 to be spaced on the base 51 of the connector bank 50 by a reduced distance. Therefore, the coaxial connector device 2 with multiple cables 20, male connectors 30 and female connectors 40 connected to all the closely spaced installation connectors 52 can have an effectively reduced overall volume.

Figure 10:
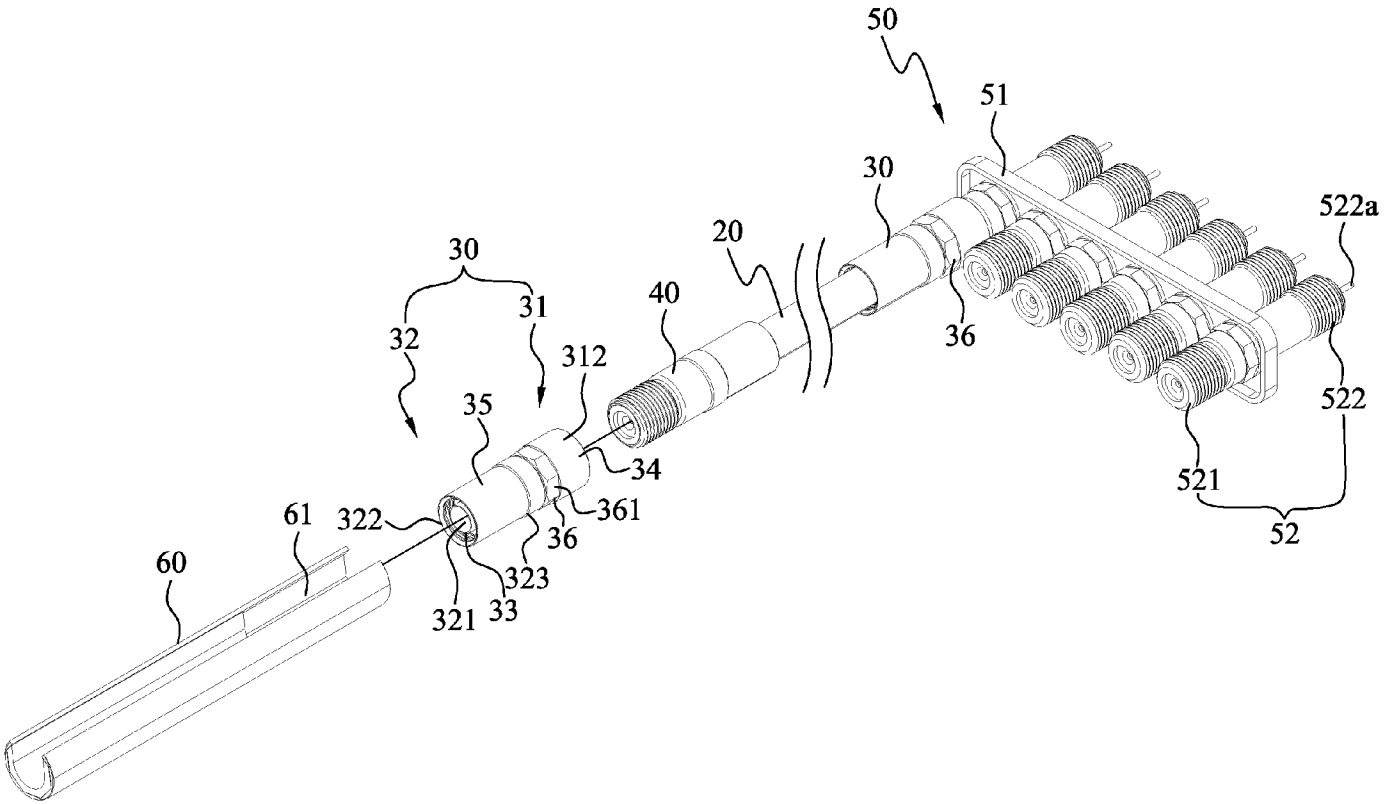
FIG. 10 is another exploded perspective view showing the use of the fastening tool to connect an additional male connector to the female connector on the second end of the cable.

Please refer to FIG. 10. In the case a signal is to be transmitted to or received from a somewhat remote location, an additional male connector 30 can be further screwed onto the female connector 40 that has already been connected to the second end 24 of the first cable 20, so that an additional cable 20 and an additional female connector 40 (not shown in FIG. 10) can be sequentially connected to the additional male connector 30. To do so, just engage the engaging space 61 of the fastening tool 60 with the tightening section 36 of the additional male connector 30 and rotate the fastening tool 60, and the screw-on space 311 of the additional male connector 30 can be screwed onto the electrical connection section 42 of the female connector 40.

Thereafter, extend the additional cable 20 (not shown) from the first end 23 thereof into the additional male connector 30, allowing the second end 23 of the additional cable 20 to be clamped and held in place by the other first claw element 452 that is located farther from the cable insertion section 41 of the female connector 40. At this point, the additional cable 20 and the first cable 20 are electrically connected to each other via the two first claw elements 452 and the conducting sleeve 451 in the electrical connection section 42 of the female connector 40.

Finally, connect the second end 24 of the additional cable 20 to an additional female connector 40 (not shown in FIG. 10). In this way, the signal can be transmitted to or received from a remote location.

As having been described above, since the grip sides 361 of the tightening section 36 are located tangentially relative to the second circumferential surface 323 and respectively have two axially extended lateral edges located flush with the first circumferential surface 312, the tightening section 36 has an outer peripheral surface radially located between the first circumferential surface 312 and the second circumferential surface 323 without radially protruded from the male connector 30. With this configuration, multiple male connectors 30 can be conveniently connected one by one to the core clamping sections 521 of the closely spaced installation connectors 52 on the connector bank 50 using the size-reduced fastening tool 60. And, the coaxial connector device 2 with multiple cables 20, male connectors 30 and female connectors 40 connected to all the installation connectors 52 on the connector bank 50 can have an effectively reduced overall volume.

Further, with the annular receiving space 322 of the male connector 30 and the annular locating space 46 of the female connector 40, when the cable 20 is inserted at the first and second ends 23, 24 into the male and female connectors 30, 40, respectively, portions of the braided conductor 26 and the jacket 27 of the cable 20 located adjacent to the first end 23 and the second 24 are automatically moved into the annular receiving space 322 and the annular locating space 46, respectively. In this manner, the portion of the central core 22 at the first end 23 of the cable 20 can be quickly extended through the male connector 30 to electrically connect to the second electrical connection member 53, and another portion of the central core 22 at the second end 24 of the cable 20 can also be quickly extended into the female connector 40 to electrically connect to the first electrical connection member 45.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A coaxial connector device, comprising:

a connector bank including a base and a plurality of installation connectors mounted on the base, and each of the installation connectors having a core clamping section and a contacting section forming two opposite ends thereof;

a male connector including a screw-on section for screwing onto the core clamping section of one of the installation connectors, a cable receiving section, and a tightening section axially located between the screw-on section and the cable receiving section; the screw-on section having a first circumferential surface of a first outer diameter, and the cable receiving section have a second circumferential surface of a second outer diameter; and the tightening section having at least one grip side radially located between the first and the second circumferential surface;

a female connector including a cable insertion section and an electrical connection section; and a cable having a central core and an insulation layer covering most part of the central core, such that two opposite ends of the central core are exposed from two ends of the insulation layer to form a first end and a second end of the cable; the first end of the cable being extended through the cable receiving section into the screw-on section of the male connector to be clamped and held in place in the core clamping section of the installation connector, enabling the first end of the cable to be electrically connected to the contacting section of the installation connector; and the second end of the cable being extended through the cable insertion section into the electrical connection section of the female connector and being held therein; and the male connector being characterized in that the grip side of the tightening section is located tangentially relative to the second circumferential surface of the cable receiving section and has two axially extended lateral edges located flush with the first circumferential surface of the screw-on section.

2. The coaxial connector device as claimed in claim 1, wherein the installation connector further has a second electrical connection member mounted in the core clamping section; and the second electrical connection member being connected at an end to the contacting section and at another end to the first end of the cable.

3. The coaxial connector device as claimed in claim 2, wherein the second electrical connection member includes a main body, a passage axially extended through the main body, and a second claw element provided in the passage and including a plurality of second claws; ends of the second claws facing toward the contacting section of the installation connector respectively forming a first clamping portion and another ends of the second claws facing away from the contacting section respectively forming a second clamping portion; the second clamping portion being further divided into a core clamping segment and a core guiding segment; the core clamping segments together clamping and holding the first end of the cable in place in the passage, and the core guiding segments together guiding the first end of the cable into the passage.

4. The coaxial connector device as claimed in claim 3, wherein the core guiding segments of the second claws are separated from one another to present a flared state, while the core clamping segments of the second claws are converged to press against one another.

5. The coaxial connector device as claimed in claim 3, wherein the installation connector further includes an axially extended conducting element located in the contacting section; and the conducting element having an end clamped by the first clamping portions of the second electrical connection member.

6. The coaxial connector device as claimed in claim 1, wherein the cable further includes a braided conductor externally covering the insulation layer and a jacket externally covering the braided conductor; and the insulation layer being formed on an inner circumferential surface at each of two ends thereof with an annular recess, so that two lengths of the central core corresponding to the two annular recesses are spaced from the insulation layer.

7. The coaxial connector device as claimed in claim 6, wherein the screw-on section of the male connector internally defines a screw-on space, and the cable receiving section of the male connector internally defines a straight-through space that is communicable with the screw-on space and an annular receiving space that is externally located around the straight-through space and not communicable with the screw-on space; wherein when the cable is extended from the first end through the straight-through space into the screw-on space, the central core at the first end and the insulation layer behind the first end are located in the screw-on space and the straight-through space, respectively, while the braided conductor and the jacket are located in the annular receiving space, and the annular receiving space and the straight-through space are now communicable with each other via the annular recess formed on the insulation layer adjacent to the first end of the cable.

8. The coaxial connector device as claimed in claim 7, wherein the male connector includes:

an inner tube having a first abutting block externally formed around an end thereof, and the straight-through space being defined in the inner tube;

a first shell externally having the first circumferential surface and the tightening section formed therearound, and internally defining the screw-on space and a second abutting block radially inward extended into the screw-on space; the first shell being externally fitted around the inner tube to form the screw-on section while the second abutting block is abutted against and hooked to the first abutting block on the inner tube, so that the inner tube has a portion projected from the first shell and the screw-on space of the first shell is communicable with the straight-through space of the inner tube; and a second shell externally having the second circumferential surface formed therearound and being externally fitted around the portion of the inner tube that is projected from the first shell to thereby form the cable receiving section, and the annular receiving space being defined between the second shell and the inner tube.

9. The coaxial connector device as claimed in claim 6, wherein the cable insertion section of the female connector internally defines an annular locating space, and the cable insertion section and the electrical connection section together define an insertion space in the female connector; the annular locating space being externally located around the insertion space but not communicable with the insertion space; wherein when the cable is extended from the second end into the insertion space of the female connector, the central core at the second end and the insulation layer behind the second end are located in the insertion space while the braided conductor and the jacket are located in the annular locating space, and the annular locating space and the insertion space are now communicable with each other via the annular recess formed on the insulation layer adjacent to the second end of the cable.

10. The coaxial connector device as claimed in claim 9, wherein the female connector includes:

a first tubular body;

a second tubular body internally defining the insertion space and having an extended sleeve portion, around which the first tubular body is fitted, and the annular locating space being defined between the extended sleeve portion and the first tubular body; and a first electrical connection member located in the second tubular body; the first electrical connection member having an end connected to the second end of the cable and another end connectable to a first end of an additional cable, such that the second end of the cable and the first end of the additional cable are electrically connectable to each other via the first electrical connection member.

11. The coaxial connector device as claimed in claim 10, wherein the first electrical connection member has a conducting sleeve, a first claw element located in each of two opposite ends of the conducting sleeve, and an annular cover fixedly held in the electrical connection section of the female connector to cover and hold the two first claw elements and the conducting sleeve in place; each of the first claw elements including a plurality of circumferentially spaced first claws; ends of the first claws that are axially pointed outward in the conducting sleeve being substantially parallel to one another to form a ring-shaped structure, and another ends of the first claws that are axially pointed inward in the conducting sleeve being converged to form a tapered structure.

* * * * *